US007565910B2

(12) United States Patent
Alexakis

(10) Patent No.: US 7,565,910 B2
(45) Date of Patent: Jul. 28, 2009

(54) ATTACHABLE SWING SHADE

(75) Inventor: Georgina Alexakis, Kildeer, IL (US)

(73) Assignee: Sunbathing Mama's LLC, Kildeer, IL (US)

( * ) Notice: Subject to any disclaimer, the term of this patent is extended or adjusted under 35 U.S.C. 154(b) by 449 days.

(21) Appl. No.: 11/280,094

(22) Filed: Nov. 16, 2005

(65) Prior Publication Data

US 2006/0119144 A1 Jun. 8, 2006

Related U.S. Application Data

(60) Provisional application No. 60/629,430, filed on Nov. 18, 2004.

(51) Int. Cl.
*E04H 15/58* (2006.01)
*A47C 7/66* (2006.01)

(52) U.S. Cl. ..... 135/117; 135/96; 297/184.1

(58) Field of Classification Search ..... 135/90, 135/96, 117; 297/184.1, 184.13–184.15; 5/121, 127, 128

See application file for complete search history.

(56) References Cited

U.S. PATENT DOCUMENTS 334,990 A * 1/1886 Shepardson ..... 297/184.15
1,104,609 A * 7/1914 Blain ..... 297/8
1,156,200 A * 10/1915 Ashworth et al. ..... 5/121
1,388,117 A * 8/1921 Nimicks ..... 135/96
1,692,522 A * 11/1928 Josefing et al. ..... 297/184.14
2,789,863 A * 4/1957 Shimabukuro ..... 296/77.1
2,912,044 A * 11/1959 Giffen ..... 297/184.15
3,840,161 A * 10/1974 Boggs et al. ..... 224/161
4,221,429 A * 9/1980 Wade ..... 297/277
4,268,087 A * 5/1981 Sorrentino ..... 297/273
4,351,524 A * 9/1982 Gomes ..... 472/124
4,997,231 A * 3/1991 Smith ..... 297/184.13
5,203,363 A * 4/1993 Kidwell et al. ..... 135/90
D339,258 S * 9/1993 Langenberg ..... D6/491
D359,857 S * 7/1995 Bartlett ..... D6/347
5,653,248 A * 8/1997 Ness ..... 135/96
5,730,490 A * 3/1998 Mortenson ..... 297/184.13
6,039,393 A * 3/2000 Roh ..... 297/184.13
D431,377 S * 10/2000 Buggs ..... D6/333
6,260,566 B1 * 7/2001 LaFave et al. ..... 135/88.01
6,296,002 B1 * 10/2001 Tashchyan ..... 135/96
7,000,625 B2 * 2/2006 Dickson et al. ..... 135/88.02
7,189,164 B1 * 3/2007 Paesang et al. ..... 472/118

* cited by examiner

*Primary Examiner*—David Dunn
*Assistant Examiner*—Tania Abraham
(74) *Attorney, Agent, or Firm*—K&L Gates LLP

(57) ABSTRACT

A readily assembled and removable shade for use with swings in which the user of the swing is afforded substantial protection from the sun, UV radiation, wind and rain is provided. The shade is configured to be used with many different types of swings.

7 Claims, 7 Drawing Sheets

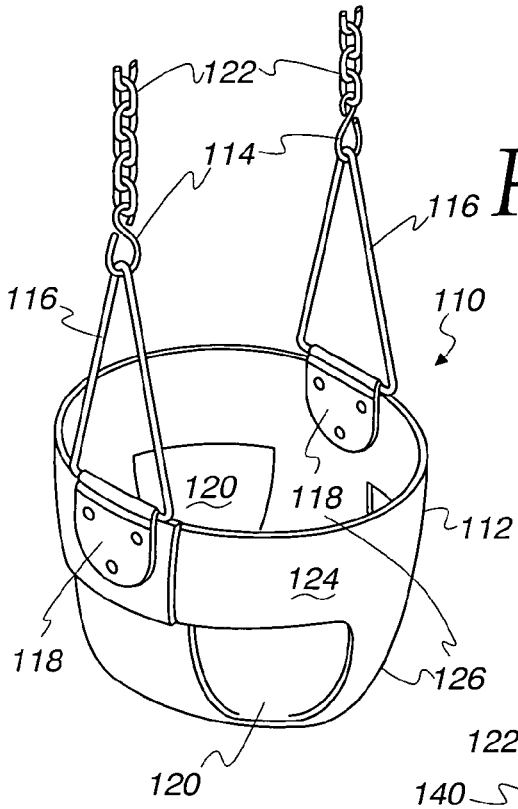
Fig. 5
Fig. 6
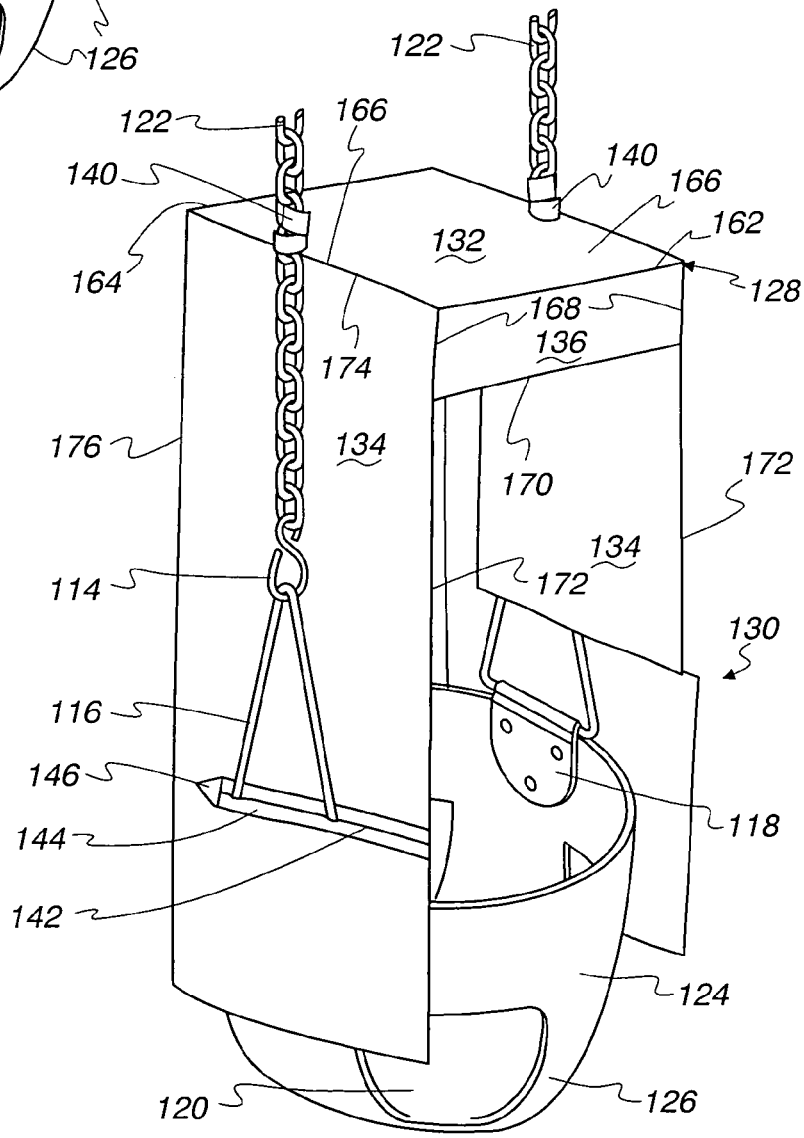

ATTACHABLE SWING SHADE

PRIORITY CLAIM

This application claims priority to and the benefit of U.S. Provisional Patent Application No. 60/629,430, filed Nov. 18, 2004, the contents of which are expressly incorporated herein by reference.

BACKGROUND

The hazards associated with sun exposure are well documented. Still, outdoor play and childhood are synonymous. Youngsters, more than adults, risk the detrimental effects of the sun's ultraviolet ("UV") rays. Children have more skin relative to their body mass. The outer layer of their skin is thinner and more sensitive than an adult's, making painful sunburns more damaging to a child. Children also have sensitive eyes, and the harmful effects of UV radiation can cause reddened and swollen eyeballs, and increased risk of cataracts in later years.

The dangers of sun exposure increase for children with very fair skin and hair, or with moles on their skin (or whose parents have a tendency to develop moles), or with a family history of skin cancer, including melanoma. Excessive sun exposure is the main cause of skin cancer. Approximately ninety percent of all skin cancers occur on sun-exposed areas of the body. Epidemiological studies demonstrate that frequent sun exposure and sunburn in childhood set the stage for high rates of melanoma later in life.

In certain areas of the world susceptible especially to ozone depletion, over-exposure to the sun is an everyday concern. Increased life expectancy, early exposure and years of exposure to UV radiation increase the chances that children today will eventually develop skin cancer. As the potential to develop skin cancer increases, so does the potential for adult pain and impaired health.

Many youngsters spend a significant amount of time outdoors. One activity children have enjoyed for centuries is swinging on a swing. Swinging is fun alone or with friends. Moreover, swings have been developed so that youngsters of all ages can enjoy playing on a swing. Parents often learn that the harmonic and constant motion of a swing is soothing for many infants, helping them to settle down or get ready for a nap or sleep.

Swinging for an extended period of time in the sun can present a risk to an infant or young child. Blocking sun from a child swinging on a swing however presents a number of difficulties. First, an infant may swing on a variety of different swings. There may be a swing at the child's home. The child may frequent one or more local parks having one or more swing sets. It is also common for parents today to schedule play in which two or more children are at one of the children's homes. A child may therefore play on different swings at different homes. A parent worried about his or her child playing for long periods in the sun may therefore find difficulty in ensuring that each of the different swings has protection from the sun.

Another issue associated with shielding the sun from a child swinging on a swing is that the child's position with respect to the sun changes virtually constantly. Shading the child at multiple angles during play on a swing can be problematic. Also, radiation reflected off surfaces can be problematic. Furthermore, rain and wind can also provide discomfort from a multitude of angles.

A need therefore exists for an improved swing shade.

SUMMARY

The present invention provides an improved shade for a swing. The shade offers protection from sun, UV radiation, wind and rain for users of a swing or like device. The shade is flexible, lightweight and readily attached and detached from a swing. The shade is therefore conveniently attached and removed from a swing located at the child's home, at a park and a friend's home, etc. The shade provides local sun, rain and wind protection and covers multiple side portions of the swing, providing protection from the sun and conditions at multiple angles as the swing changes direction during its motion.

In one embodiment, the shade includes a cover. The cover in an embodiment is light-weight and water-resistant. The cover can be made of one or more different materials, such as a woven material, nylon, fabric, linen, woven linen, canvas, cotton, plastic, rubber, polymer, polyvinyl and any combination thereof.

The shade also includes one or more fasteners that enable the cover to be fastened to the swing. The fasteners may be of any one or more different types of fasteners, such as an interference (VELCRO®), hook and loop, ties, buttons, buckles, snaps, alligator or bulldog clips and any combination thereof. In an embodiment, the fasteners or fastening devices attach the cover in a removable manner to the swing supports.

In various embodiments, the shade fits swings having two or four supporting members holding the swing to a frame or support. It should be appreciated from the teachings of the present invention however that the shade is adaptable to fit many different types of swings, including unorthodox swings, such as a tire hanging from a tree or other support. The swing supporting members are typically made of ropes or chains. The swing shade in an embodiment attaches to and is supported by the rope or chain supporting members.

In the case of four supporting members, the covering of the shade attaches to all four supporting members in one embodiment. The shade covers the child from above, the sides, the back and at least a portion of front. The cover of the shade includes flaps that hang from the top portion of the cover in one embodiment.

When the swing includes two supporting members, the cover of the shade attaches to the two members. Here, the top portion of the cover includes a poly-carbonate, rigid or semi-rigid material. Such material provides a rigid or semi-rigid top portion from which side portion, rear and/or front panels depend, providing full or near full protection from the sun and other ambient conditions on the sides and rear of the child.

The fasteners are of a quick-connect and quick-disconnect nature so that a parent can readily assemble and disassemble the shade onto and from the swing. In an embodiment fasteners are located at the top portion of the cover of the shade. Those fasteners attach the shade to the swing supporting members, e.g., ropes or chains, at locations above the occupant. Fasteners are also provided at the bottom sections of the side portions and/or back portion so that each side portion and/or back portion can be fastened in place and prevented from flapping in the wind.

The cover of the shade can be opaque, translucent and perhaps partially transparent. In a preferred embodiment, the cover blocks the child from the sun. The cover may however have a see through portion(s) so that the parent can view the child while inside the cover. The cover can also be tinted or have a coating similar to that used with sunglasses, which blocks harmful UV rays but allows the child to see out and the parent to see into the shade. The cover, e.g., the back of the cover, may also be provided with smaller openings, cracks or vents to enable air to flow through the cover while the swing is in motion. Alternatively, the material is woven or otherwise constructed to be partly open so that air may flow through the cover.

The outside and/or inside of the shade includes indicia in one embodiment, which can be amusing and interesting for children and infants. The indicia in an embodiment is provided on multiple faces of the cover of the shade. The indicia on one face can match indicia on another face to produce a three-dimensional shape of an object, such as an animal, cartoon character, book character and the like.

To the above-described ends, in one embodiment a removable shade for a swing is provided. The swing includes a seat that holds an occupant and first and second members to which the seat is attached for support. The shade includes a top portion and a first side portion depending from the top portion to provide shade for the occupant and a second side portion depending from the top portion to provide shade for the occupant. The shade includes a first fastener configured and arranged to connect to the first member of the swing. The first fastener is connected to the top portion or the first side portion. A second fastener is provided and is configured and arranged to connect to the second member of the swing. The second fastener is connected to the top portion or the second side portion.

In an embodiment, the removable shade includes a third member supporting the seat, and a third fastener is configured and arranged to connect removable the shade to the third member. The third fastener can be connected to the top portion or the first side portion.

In an embodiment, a fourth member supports the seat and a fourth fastener is provided, which connects the removable shade to the fourth member. The fourth member can be connected to the top portion or the second side portion.

In an embodiment, the first fastener is configured and arranged to connect to the first member above the occupant. The removable shade also includes a third fastener configured and arranged to connect the first side portion to the first member at a position below the first fastener.

In an embodiment, the second fastener is configured and arranged to connect to the second member above the occupant. The removable shade further includes a third fastener configured and arranged to connect the second side portion to the second member at a position below the second fastener.

In an embodiment, the removable shade includes a back portion depending from at least one of the top portion and each side portion. The removable shade can include a third fastener configured and arranged to connect a lower section of the back portion to one of the first and second members.

In an embodiment, the removable shade includes a front depending from at least one of the top portion and each side portion.

In an embodiment, the removable shade includes a top portion that is at least semi-rigid.

In an embodiment, the removable shade top portion includes an insert, wherein the insert is at least semi-rigid.

In an embodiment, the shade includes a first and second fastener of a type selected from a group including interference, hook and loop, tie, button, buckle, snap, alligator clip, bulldog clip and any combination thereof.

In an embodiment, at least one of the top portion and each side portion is made of a material selected from a group including a woven material, nylon, fabric, linen, woven linen, canvas, cotton, plastic, rubber, polymer, polyvinyl and any combination thereof.

In an embodiment, at least two panels of the top, the first side portion and the second side portion include indicia that mate when the shade is installed on the swing.

In another embodiment, a removable shade for a swing having a seat that holds an occupant with first and second members to which the seat is attached for support is provided. The shade includes a top portion and a back portion depending from the top. The back portion provides protection to the back portion of an occupant. A first fastener is configured and arranged to connect to the first member. The first fastener is connected to the top portion or the back portion. A second fastener is configured and arranged to connect to the second member. The second fastener is connected to the top portion or the back portion.

In an embodiment, at least one of the first and second fasteners is configured and arranged to connect to the first and second member, respectively, above the occupant. The removable shade includes at least one additional fastener configured and arranged to connect the back portion to the first or second member at a position below the at least one first and second fastener.

In an embodiment, the top portion and back portion have indicia that mate when the shade is installed on the swing.

In yet another embodiment, an ambient condition protection method for a child is provided. The method includes (1) structuring a cover to fold over the child in a swing to provide ambient condition protection to the child in multiple directions; and (2) securing fasteners to the cover to enable the cover to be readily attached and detached from the swing.

In an embodiment, the method includes the step of structuring the cover to fold over a particular type of swing.

It is therefore an advantage of the present invention to provide a removable shade for a swing.

It is another advantage of the present invention to provide a removable swing shade that is easily assembled and disassembled from the swing.

It is a further advantage of the present invention to provide a removable swing shade that may be used on a variety of different swings of approximately the same type.

It is yet another advantage of the present invention to provide a removable swing shade that is adaptable to fit different types of swings.

Moreover, it is an advantage of the present invention to provide a removable shade that protects a child or infant from multiple ambient conditions, such as sunlight, rain and wind.

Additional features and advantages of the present invention are described in, and will be apparent from, the following Detailed Description of the Invention and the figures.

Additional features and advantages are described herein, and will be apparent from, the following Detailed Description and the figures.

BRIEF DESCRIPTION OF THE FIGURES

FIG. 5 is a perspective view of a toddler swing with two supporting members.

FIG. 6 is a perspective view of one embodiment of the swing shade of the present invention installed on the swing of FIG. 5.

DETAILED DESCRIPTION

Figure 1:
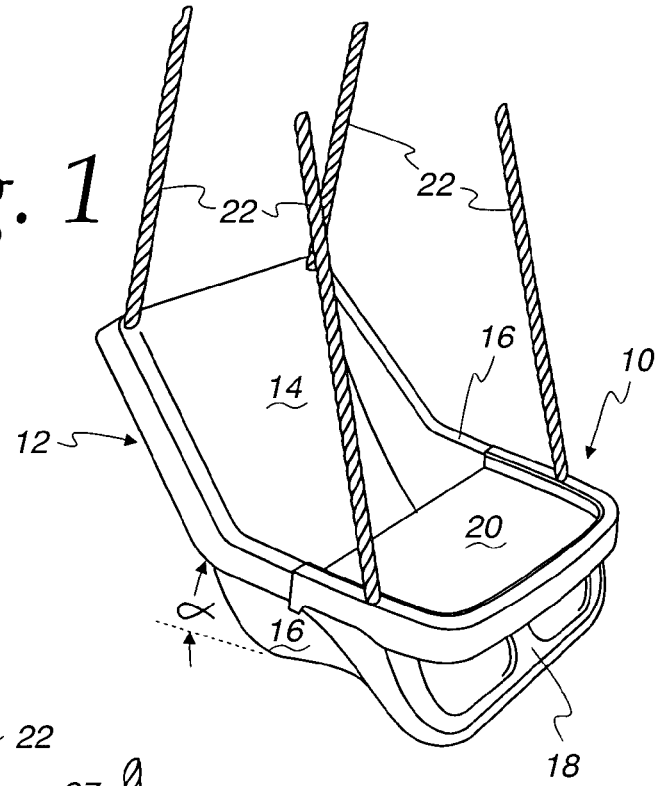
FIG. 1 is a perspective view of a toddler swing with four supporting members.

Referring now to the drawings, where several embodiments of the claimed invention are illustrated in detail. In particular, a toddler swing 10 with four supporting members is shown in FIG. 1. Generally, toddler swing 10 of this type has a seat 12 supported from above by four supporting members 22, such as ropes, chains (e.g., plastic coated) or the like. Members 22 support seat 12 and a child or toddler sitting in seat 12. Swing seat 12 is made of plastic, metal, wood, rubber, polymer and the like. Seat 12 has a back portion 14, side portions 16, a front 18 and a table or desk like top portion 20. The seat back portion 14 is angled and shaped at angle $\alpha$. Seat 12, angle $\alpha$ and seat back portion 14 provide support and security for a toddler while occupying and swinging in swing 10.

Figure 2:
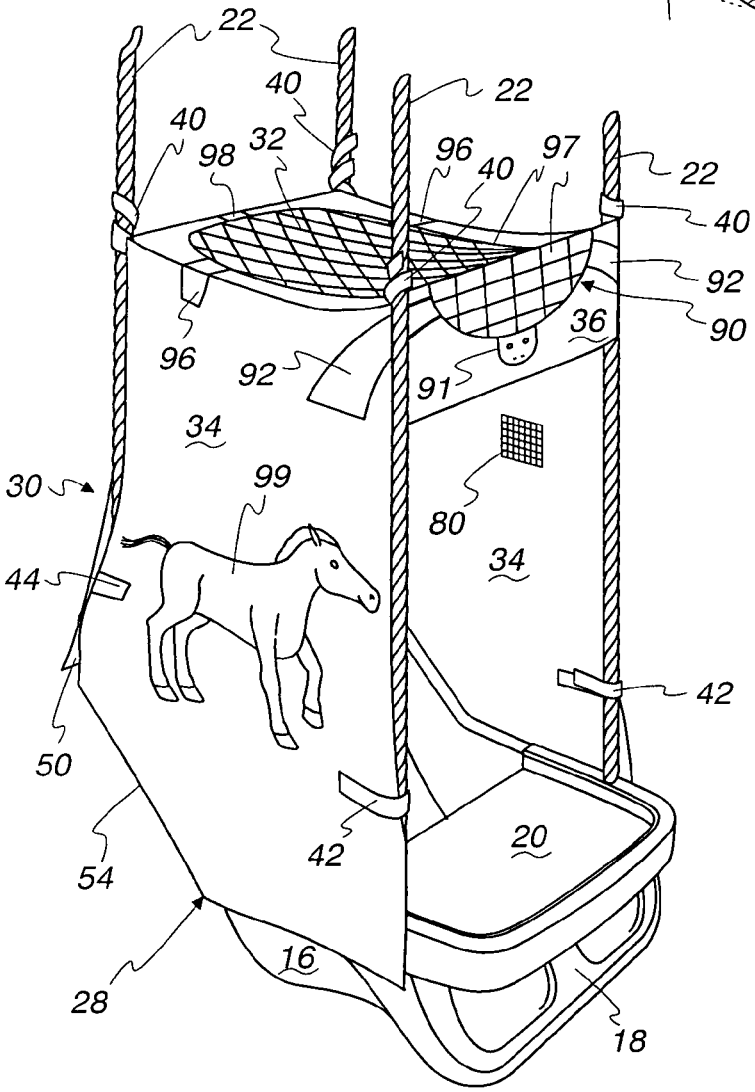
FIG. 2 is a perspective view of one embodiment of the swing shade of the present invention installed on the swing of FIG. 1.
Figure 3:
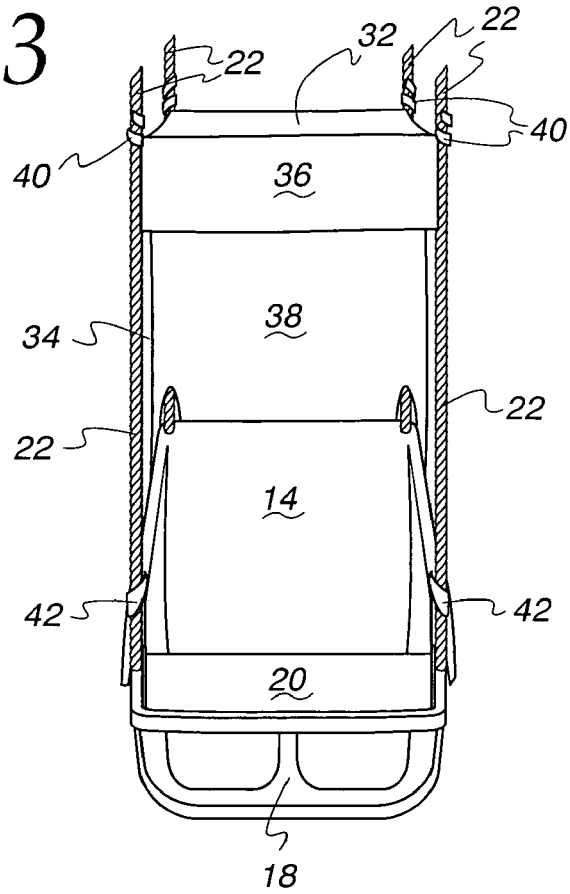
FIG. 3 is a front elevation view of the swing shade of FIG. 2.
Figure 4:
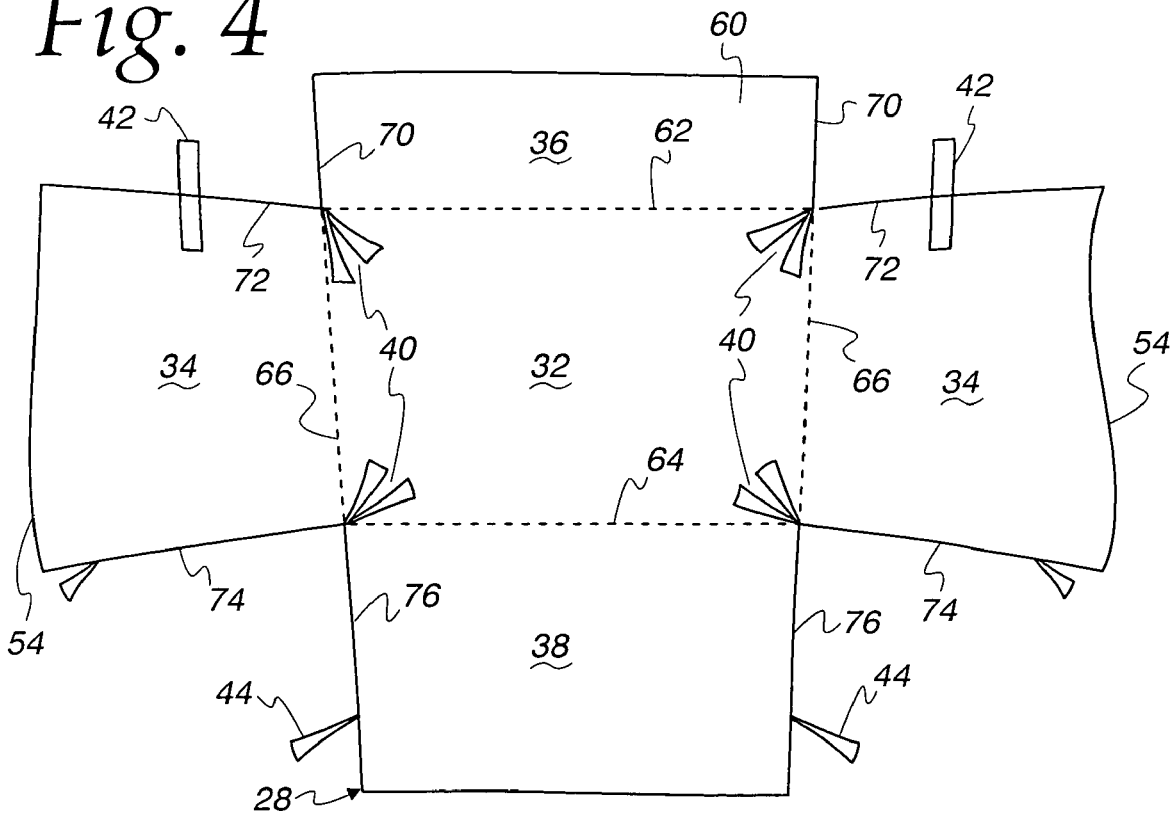
FIG. 4 shows the swing shade of FIGS. 2 and 3 in the flat.

Referring now to FIGS. 2 to 4, one embodiment of the present invention is illustrated by swing shade 30. In the illustrated embodiment, swing shade 30 fits over the four support members 22 of swing 10 of FIG. 1. Shade 30 it should be appreciated provides protection from the sun, UV radiation, wind and rain, etc. (referred to herein for convenience and not for limitation as "elements" or "ambient conditions").

Swing shade 30 includes a cover 28 and a plurality of fasteners. Cover 28 in an embodiment is made of a woven material, nylon, fabric, linen, woven linen, canvas, cotton, plastic, rubber, polymer, polyvinyl and any combination thereof. Cover 28 may be translucent or opaque and may include translucent, see-through, mesh, holes, cracks or the like in the panels as windows and/or air holes 80. It should be understood that these windows and/or air holes can have any suitable shape and number, and can be used with any of the embodiments described herein. Any part of cover 28 may include a UV blocking film or coating that blocks harmful energy from the sun and enables the parent or caretaker to view the child, toddler or infant located on swing 10 and inside shade 30.

Cover 28 in the illustrated embodiment includes a top panel or top portion 32, side panels or side portions 34, a front panel or front portion 36 and a back panel or back portion 38. FIG. 4 shows that top portion 32, side portions 34, front portion 36 and back portion 38 of cover 28 are made in one embodiment from a single piece of material and are folded about members 22 of swing 10. Upper fasteners 40 are provided to removably fix shade 30 to swing 10. Shade 30 is therefore readily attached to (and detached from) and supported by supporting members 22 (ropes, chains, etc) of swing 10.

Upper fasteners 40 are sewn, adhered or otherwise connected to a top portion of cover 28, for example to top portion 32, side portions 34, front portion 36, back portion 38 or any combination thereof. Upper fasteners 40 can also be connected directly at the fold lines between the top portion 32, side portions 34, front portion 36, back portion 38. In an embodiment, upper fasteners 40 are located at or near the corners of top portion 32 to pull top portion 32 substantially taught above the occupant of swing 10. The spatial relationship of fasteners 40 to top portion 32 also enables cover 28 of shade 30 to be supported above seat 12 by the four supporting members 22.

Fasteners 40 as well as any fasteners described herein may include interference fit (e.g., Velcro®), hook and loop, ties, buttons, buckles, snaps, alligator or bulldog clips, etc., and any combination thereof. In an embodiment, cover 28 is light enough and fasteners 40 are robust enough that any single initially connected fastener 40 can support the weight of the cover 28, so that the user can conveniently connect each of the remaining fasteners using two hands.

Side portions 34, front 36 and back portion 38 fold downwardly from top portion 32 along edges as seen in FIG. 4. Side portions 34 may be formed integrally with top portion 32 as shown in FIG. 4 or may be sewn to, adhered to or otherwise connected to top portion 32. In either case, side portions 34 when assembled to swing 10 depend or extend from edges 66 (FIG. 4) downwardly from top portion 32. Each side portion 34 includes edges 72 and 74 (FIG. 4), which extend from the top portion 32 to at least a portion of the side portions 16 of the swing 10 when cover 28 is installed to swing 10. In an embodiment, side portions 34 of shade 30 are tailored to fit the shapes of toddler swings via the angled or contoured edges 54 along the rear and bottom section of the side portions 34. Edges 54 are angled or contoured as necessary to fit a particular swing 10.

Front portion 36 depends or extends downwardly from top portion 32 along edge 62 (FIG. 4). Front portion 36 in the illustrated embodiment does not extend downwardly as far as side portions 34 or back portion 38, allowing the occupant of swing 10 to see out of shade 30 and be visible from the front of shade 30. Opposing side edges 70 of front portion 36 can be attached to front edges 72 of side portion 34, e.g., via a zipper or other fastener listed above, or be attached directly to supporting members 22 of swing 10.

Back portion 38 as seen in FIGS. 3 and 4, depends or extends downwardly from top portion 32 via edge 64. Back portion 38 includes edges 76 extending from top portion 32 down at least a portion of the swing seat back portion 14 when shade 10 is installed to swing 10. Edges 76 of back portion 38 may be attached to edges 74 of the side portions 34, e.g., via a zipper or other fastener listed above. Alternatively, edges 76 of back portion 38 are attached directly to members 22.

As seen in FIG. 2, the bottom portions of back portion 38 and side portions 34 come together to form a slit or opening 50 so that member 22 can pass through cover 28. Back portion 38 and side portions 34 at opening 50 tend to overlap each other to allow cover 28 to be easily installed and removed from swing 10 and still provide good protection from the elements. Back portion 38 and/or side portions 34 has lower fasteners 44 located near slit 50. Lower fasteners 44 attach and secure the back portion 38 and/or side portions 34 to the other of the side portions 34 or back portion 38 and around ropes 22. Back portion 38 and side portions 34 are therefore precluded from flying or flapping up due to the wind or other disturbances.

Side portions 34 likewise include lower front fasteners 42 that batten or tie the lower front edges of side portions 34 to members 22 of swing 10. Although not illustrated, front portion 36 may also include lower fasteners to secure the lower edge of same to members 22.

FIG. 4 shows swing shade 30 in a flat, unassembled state. As discussed above, swing shade 30 can be fabricated from one or more individual panels of material. A central panel 60 includes the front portion 36, top portion 32 and back portion 38 and can be one contiguous panel either with side portions 34 or made as one contiguous panel with the rest of cover 28 being made of several individual panels. In one embodiment, front portion 36 is folded down along line 62. Side portions 34 are folded down along lines 66. Edges 70 and 72 are attached. Back portion 38 is folded down along line 64 and attached along an upper portion of edges 76 to edges 74 of side portions 34.

The present invention takes advantage of the three-dimensional configuration of the shade described herein by providing a series of panels 32, 34, 36 and 38 having decorative, ornamental or fanciful themes and any combination thereof. The panels may also include bright colors, patterns, lines, shapes and any combination thereof. The various panels can include one or a series of cartoon characters, childhood book and movie characters, animals, action figures, comic book characters, landscapes, pictures and any combination thereof. In the illustration, a turtle 90 is depicted on shade 30. The overall image of turtle 90 is shown on multiple panels. Front 36 for example shows head 91 of turtle 90. Head 91 is connected to a body 97 located on front 36 and top portion 32. Front feet 92 extend from body 97 of turtle 90. Front feet 92 extend from front 36 to side portions 34. Body 97 extends from front 36 to top portion 32. Turtle 90 has rear feet 96 extending from body 97 on top portion 32 to side portions 34. Feet 96 continue on side portions 34 as shown. Turtle 90 has tail 98 that extends along top portion 32 and down on back portion 38. The indicia is provided on the panels so that the turtle or image is formed by matching indicia on the various panels. The overall effect is a three-dimensional like picture or drawing.

In an additional embodiment, panels may include depictions contained wholly on each panel as shown on side 34 by picture 99. It should be understood that these depictions can be used in any combination thereof, and can be used with the other embodiments described below. Any of the disclosed indicia may be provided on any of the shades disclosed herein.

Referring now to FIG. 5, a different typical toddler swing 110 is shown with two supporting members 122, e.g., ropes or chains. Swing 110 of this type includes a seat 112 supported from above by members 122. Swing seat 112 is made of plastic, metal, wood, rubber and the like. Seat 112 in the illustrated embodiment is bowl shaped with an upper, circular portion 124 and a lower, bowl shaped portion 126. Seat 112 includes knock-outs or cut-outs 120 for the toddler's feet. A toddler may sit in swing 110 and face either front or back.

Swing seat 112 connects to support members 122 via links 114. Links 114 may be S-links, horseshoe, hook, bar, loop and other like fastening devices. Links 114 connect moveably to brackets 116. Brackets 116 as illustrated are generally triangular in shape, but are alternatively circular, rectangular, S-bracket, horseshoe, hook, bar, loop or other shaped devices. Bracket 116 is connected to the swing seat 112 by fastener 118.

Referring now to FIGS. 6, 7, 10A and 10B, another embodiment of the swing shade of the present invention is illustrated by shade 130. Swing shade 130 may be employed when a swing such as swing 10 has only two supporting members 122 holding the swing. Swing shade 130 includes a cover 128. Cover 128 is made of woven material, nylon, fabric, linen, woven linen, canvas, cotton, plastic, rubber, polymer, polyvinyl or like material. Cover 128 may be translucent or opaque and may include translucent, see-through, mesh, holes, cracks or the like in the panels as windows and/or air holes in the side portions, top portion, back portion, etc.

Figure 10A:
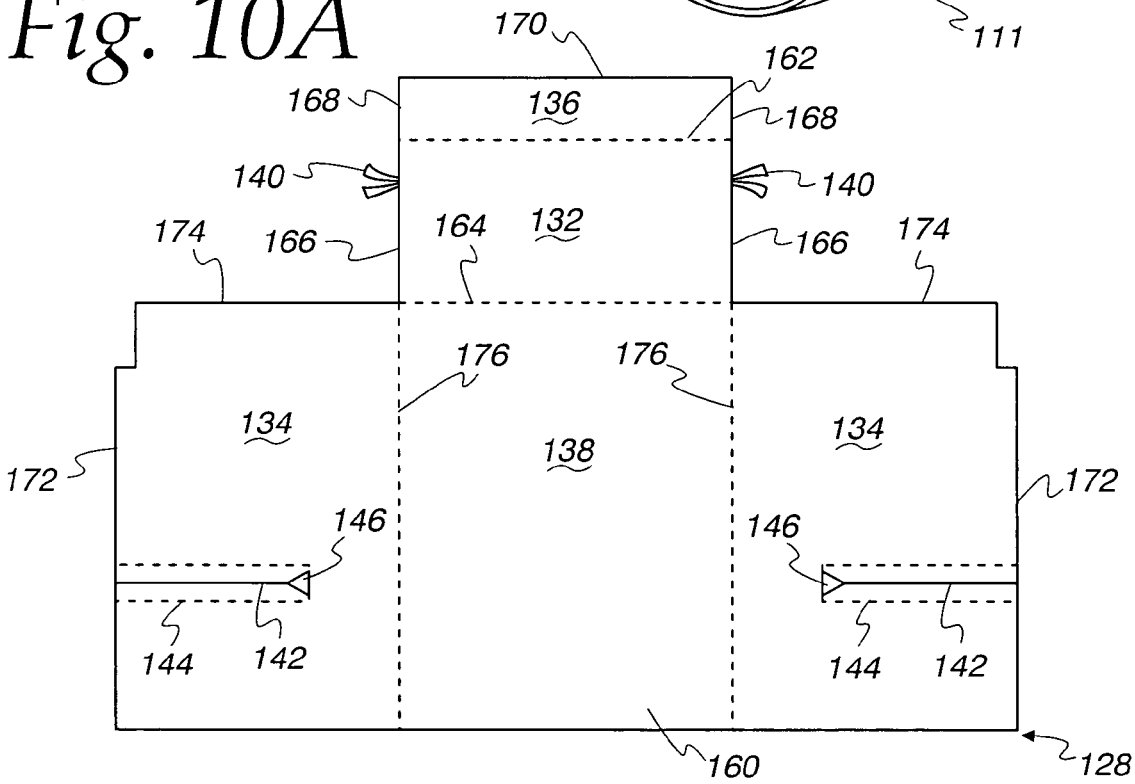
FIGS. 10A to 10B show a view of one embodiment of the swing shade of FIGS. 6 and 9 in the flat and a rigid or semi-rigid insert, respectively.
Figure 10B:
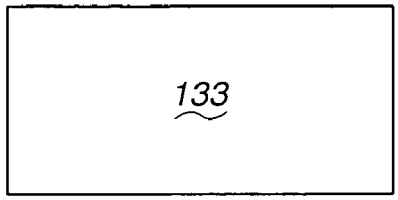

Cover 128 includes a top portion 132. In the illustrated embodiment, top portion 132 includes a semi-rigid or rigid, e.g., poly-carbonate like, material 133 as seen in FIG. 10B. Such semi-rigid or rigid material is covered on the top portion and bottom by woven material, nylon, fabric, linen, woven linen, canvas, cotton, plastic, rubber, polymer, polyvinyl or like material. Material 133 is sewn, adhered or simply placed into top portion 132 via one or more edges 162, 164 or 166. The open edge(s) may then be heat sealed or bonded closed.

Figure 7:
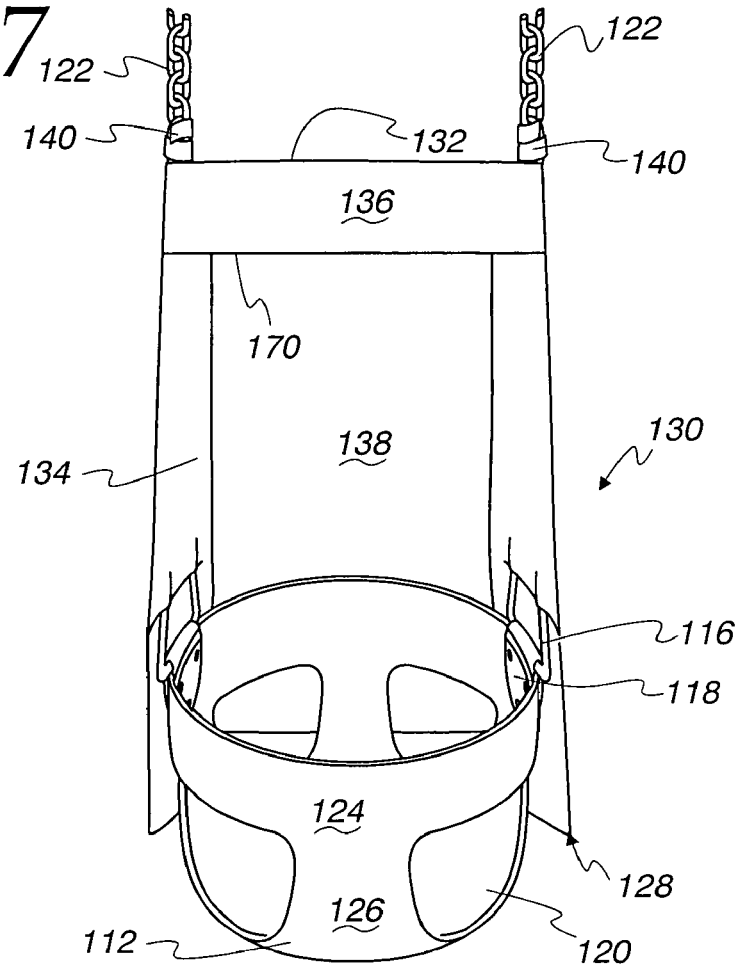
FIG. 7 is a front elevation view of the swing shade of FIG. 6.

Rigid or semi-rigid top portion 132 enables cover 128 to remain generally flat above the swing occupant. Top portion 132 provides the shape and support for the remainder of cover 128. As seen in FIGS. 6 and 7, upper fasteners 140 are attached to top portion 132. Alternatively, fasteners 140 attach to side portions 134 or back portion 138. Fasteners 140 attach cover 128 of shade 130 to supporting members 122. In one embodiment, fasteners 40 are located relatively centrally (front to back) on cover 128, so that cover 128 hangs straight down. Fasteners 140 may be any of the types listed above for fasteners 40, such as Velcro®, hook and loop, ties, buttons, snaps, and other similar types of fastening devices.

Edges 174 of side portions 134 are attached to mating edges 166 of the top portion 132. Each side portion 134 also has a front edge 172 and a folding edge 176. Side portions 134 define a slit 142, which enables cover 128 of shade 130 to fit around the swing's supporting brackets 116. When shade 130 is secured on swing 110, slits 142 extend around brackets 116 as seen in FIG. 6. Side portions 134 below slit 142 reside outside seat 112. Above slit 142, side portions 134 reside inside links 114, brackets 116 and members 122. The slits 142 extend backwards from front edges 172 of side portions 134 until terminating at point 146. Fastening devices 144 close slit 142 around supporting bracket 116. Fastening devices 144 may include any of the types listed herein, such as Velcro®, hook and loop, ties, buttons, snaps, alligator or bulldog clips and other similar types of fastening devices.

Back portion 138 seen in FIG. 7 is attached to folding edge 164 of top portion 132. As before, side portions 134, back portion 138 and front 136 may be integral to each other or attached to top portion 132 and to one another. Back portion 138 connects to side portions 134 via folding edges 176 (FIG. 10A) that extend from top portion 132 to at least a portion of seat 112 of swing 110. Side portions 134 and back portion 138 cover the upper portion 124 of seat 112 when shade 130 is installed. Edges 176 and back portion 138 are attached to or integral with side portions 134, covering side portions and rear of swing 110.

Front 136 depends or extends from top portion 132. Front portion 136 folds from top portion 132 along line 162 (FIG. 10A). Front portion 136 has an edge 170 that extends down from top portion 132 a portion of the way, allowing the swing occupant to see and be visible when sitting in seat 112. Edge 170 may extend as far down as desired to maximize protection and visibility. As before, front 136 may be integral with or connected to top portion 132. Edges 168 of front portion 136 may also be attached removably to front edges 172 of side portions 134. Also, edges 174 of side portions 134 may be attached removably to edges 166 of top portion 132.

Stiff lining 133 of top portion 132 may have a central stiffening rod or member (not illustrated), which provides further stiffness at a central portion of top portion 132 leading to fasteners 140. Although not illustrated, additional lower fasteners may be provided that connect cover 128 to swing 110. The lower fasteners prevent side portions 134 and back portion 138 from flying up from the wind, etc. Alternatively, fasteners 144 are sufficient for this purpose.

Figure 8:
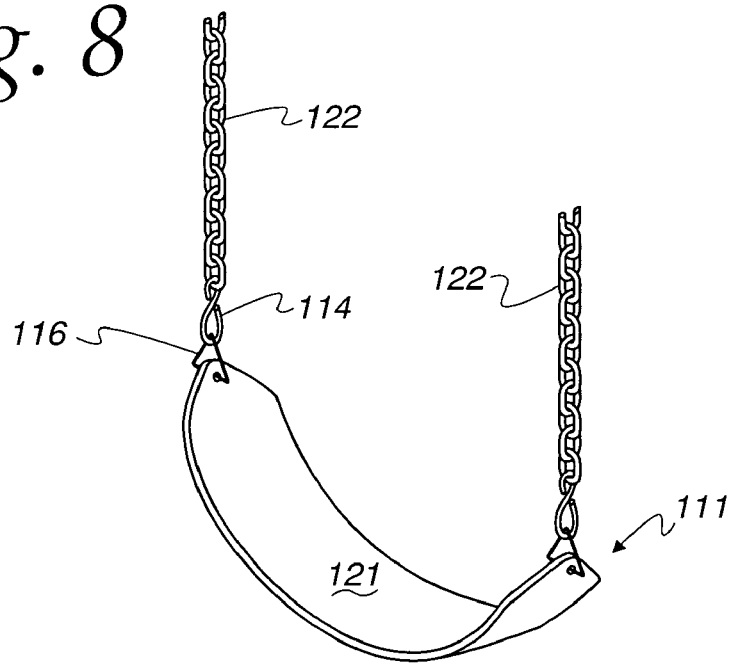
FIG. 8 is a perspective view of a different swing with two supporting members.

Referring now to FIG. 8, another embodiment of a two chain swing 111 is illustrated. A person may sit in swing 111 and face either front or back. The swing seat 121 is supported by members 122. Seat 121 may be made of rubber, plastic, metal, linen, polymer or the like. Members 122 connect to links 114. Links 114 may be of the types described above, such as, S-brackets, horseshoe, hook, bar, loop and other like fastening devices. Links 114 are connected to support brackets 116. Support brackets 116 may be triangular in shape, circular, rectangular, S-bracket, horseshoe, hook, bar, loop and other like fastening devices.

Figure 9:
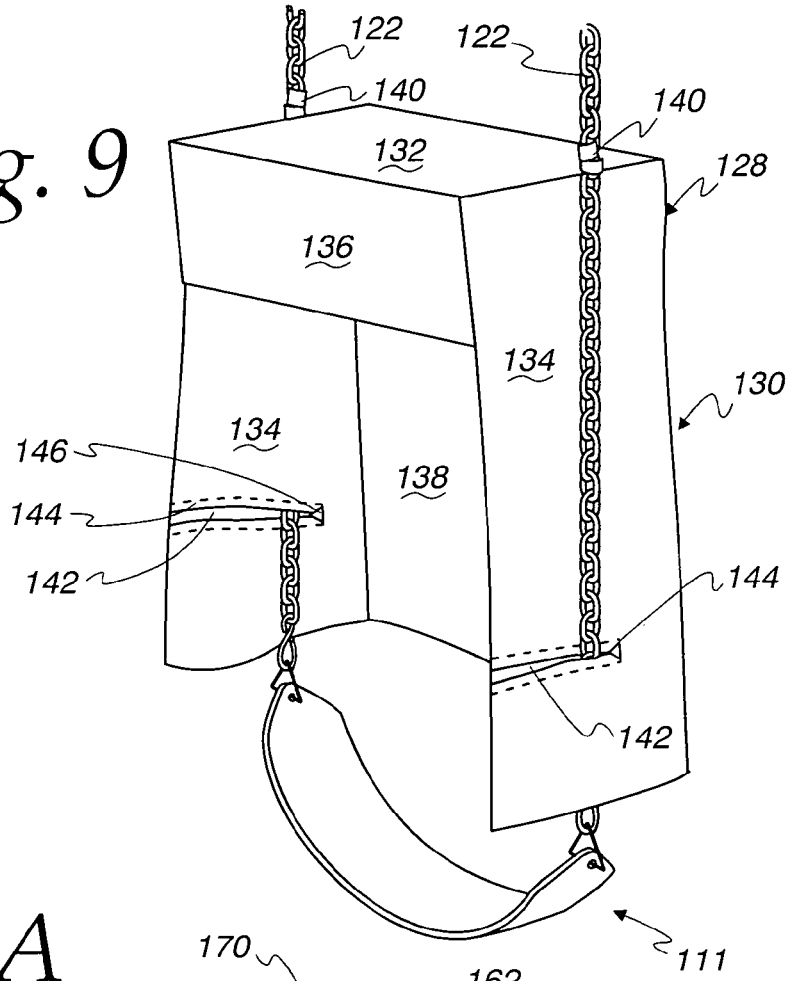
FIG. 9 is a perspective view of one embodiment of the swing shade of the present invention installed on the swing of FIG. 8.

FIG. 9 depicts swing 111 with shade 130 described above. Shade 130 is the same shade described above in connection with FIGS. 6, 7, 10A and 10B including all alternatives. Shade 130 fits onto swing 111 in a similar manner to swing 110. Top portion 132 includes stiff insert 133, which sets the shape of the installed shade 130. Swing 111 does not round out the lower portion of cover 128 of shade 130 as does swing 110. However, stiff insert 133 sets the upper and lower shape of shade 130 in FIG. 9. As before, slit 142 enables cover 128 to fit around supporting members 122 of swing 111. Lower fasteners 144 enable slit to be closed around members 122 and to hold the bottom of cover 128 in place. Cover 128 of shade 130 is held in place at the top portion via upper fasteners 140 as described in connection with FIGS. 6 and 7.

FIG. 10A shows a cover 128 in a flat, unassembled state. Cover 128 can be fabricated from one or more individual panels of material. Central portion 160, including side portions 134 and back portion 138 can be one contiguous panel with the top portion 132 and front portion 136. Alternatively, any side portions 134, back portion 138 and front portion 136 may be attached to top portion 132. To assemble shade 130, stiff lining 133 made of a polycarbonate, foam, cardboard, metal, plastic, polymer, graphite or like material is covered with a woven material, nylon, fabric, linen, woven linen, canvas, cotton, plastic, rubber, polymer, polyvinyl or like material to form top portion 132. Front portion 136 is either a separate panel from top portion 132 or is contiguous with top portion 132. Front portion 136 is folded down along line 162. Fasteners 140 are attached side edges 166 near the mid-section of top portion 132. Side portions 134 are folded from back portion 138 along lines 176. Edges 174 of side portions 134 attach to the edges 166 of top portion 132 in one embodiment. Edges 168 of front portion 136 may also attach to edges 172 of side portions 134.

Figure 11:
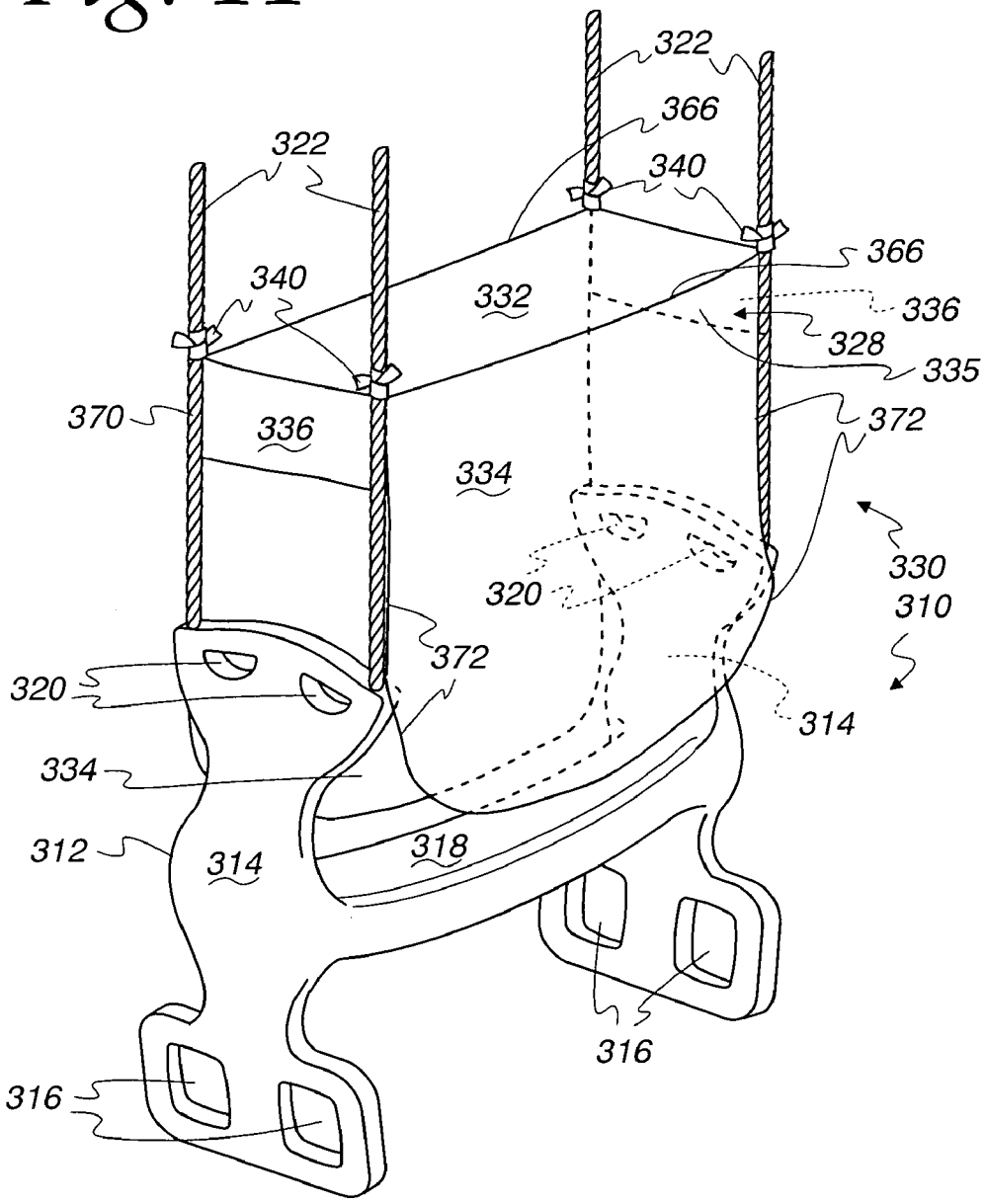
FIG. 11 is a perspective view of one embodiment of a shade of the present invention that fits a two person swing with four supporting members.

Referring now to FIG. 11, a two-person toddler swing 310 and one embodiment of a shade 330 of the present invention are shown. Swing 310 includes seat 312. Seat 312 may be made of rubber, plastic, metal, wood, polymer or the like. Seat 312 includes a bench 318 in which the swing occupants sit. Seat 312 includes side portions 314 defining cut-outs 316 to rest one's feet. Cut-outs 320 are also provided on the upper portion of side portions 314 for the rider's hands. Seat 312 is supported from above by supporting members or ropes 340, which attach to and support seat 312 at side portions 314.

Cover 328 of shade 330 is made of woven material, nylon, fabric, linen, woven linen, canvas, cotton, plastic, rubber, polymer, polyvinyl or like material described herein. Cover 328 of shade 330 made be translucent or opaque and may include translucent, see-through, mesh or the like in the panels as windows as described herein. Shade 330 is readily attachable to and supported by members 322. Fasteners 340 connected to top portion 332 at or near its corners affix to members 322 and support the cover 328. Fasteners 340 may be of various types, such as Velcro®, hook and loop, ties, buttons, buckles, snaps, alligator or bulldog clips and other similar types of fastening devices described herein. Top portion 332 is pulled generally flat.

A pair of side portions 334 extend or depend from top portion 332 along edges 366. Edges 372 of side portions 334 cover at least most of the distance to bench 318, blocking a majority of the sun, rain, and wind from the side portions. Lower fasteners (not illustrated) may be provided on each side portion 334 to hold side portions 334 in place.

Shade 330 also includes two front portions 336. Front portions 336 enable both toddlers occupying the swing to be able to look out and be seen. Front portions 336 are formed integrally with or attach to top portion 332. Opposing edges 370 of front portions 336 attach to side edges 372 of side portions 334 in one embodiment. Front portions 336 may also have lower fasteners.

Shade 330 is made of one piece or multiple pieces as described above. Shade 330 is readily attached and removed from swing 310. Moreover, each of the alternatives described above for the other embodiments is applicable to shade 330.

Figure 12:
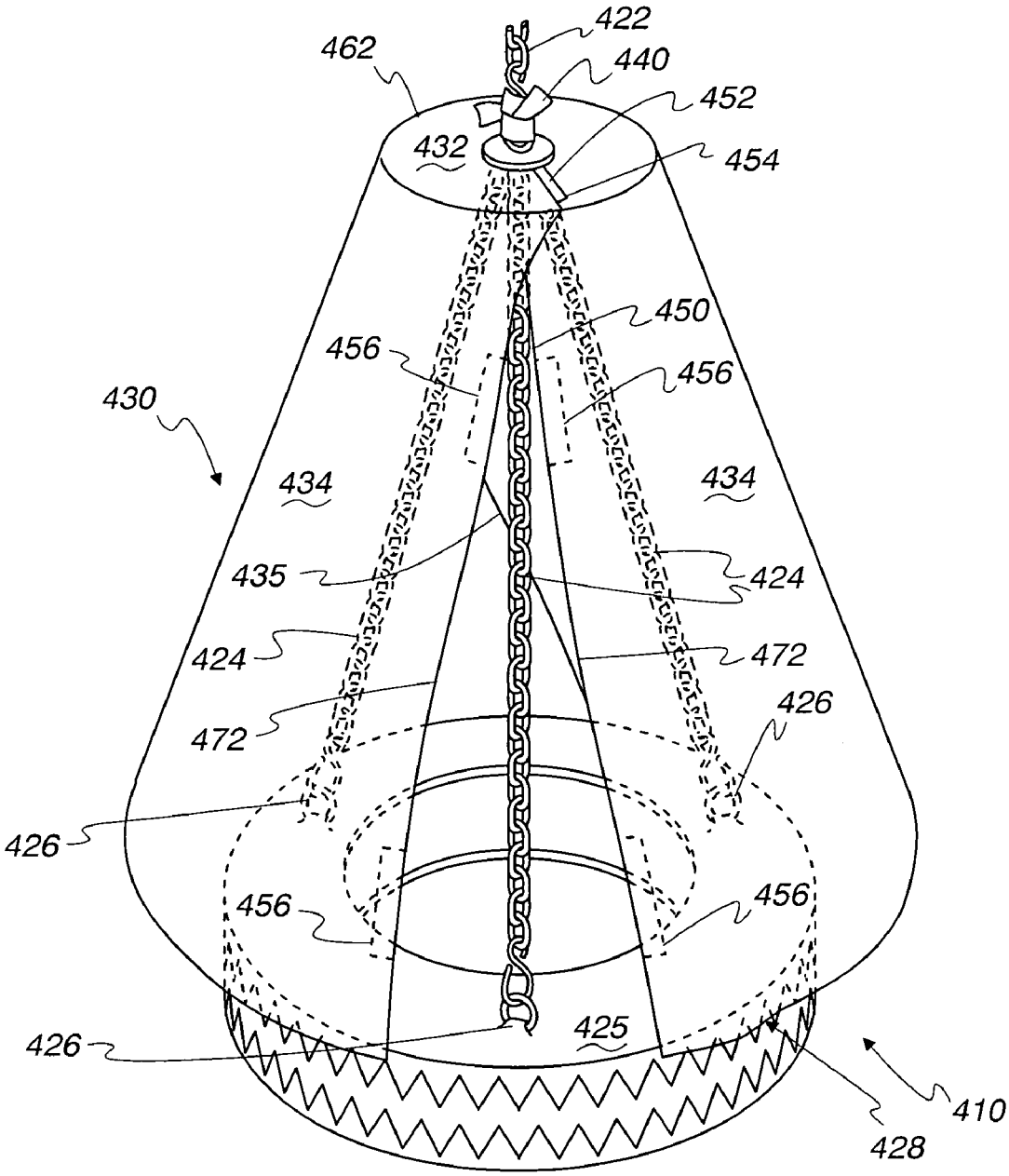
FIG. 12 is a perspective view of one embodiment of a shade of the present invention that fits a tire swing.

Referring now to FIG. 12, one embodiment of a swing shade 430 covering a tire swing 410 is illustrated. Swing 410 includes a single supporting member or chain 422. Tire and disc swings generally have one chain supporting the swinging apparatus, wherein the chain may connect to the center of the tire or disc, or as depicted, chain 422 may connect to three sub-chains 424. Sub-chains 424 connect to the disc or tire 425 at fasteners 426 along the upper edge of the tire or disc 425.

Cover 428 of shade 430 is made of woven material, nylon, fabric, linen, woven linen, canvas, cotton, plastic, rubber, polymer, polyvinyl or like material as described above. The covering apparatus may be translucent or opaque and may include translucent, see-through, mesh or the like in the panels as windows as described herein. A stiff top portion 432 enables the rest or cover 428 to extend downward. Top portion 432 is generally flat and connected to supporting member 422 via fasteners 440. In the illustrated embodiment, top portion 432 includes a stiff or poly-carbonate like material (not shown), covered by woven material, nylon, fabric, linen, woven linen, canvas, cotton, plastic, rubber, polymer, polyvinyl or like material.

Top portion panel 432 includes a slit 452, enabling cover 428 to fit around member 422. Slit 452 includes fasteners 454 that close and secure slit 452 around the member 422. Top portion 432 also includes fasteners 440 attached at or near the center of top portion 432. Fasteners 440 allow cover 428 to be affixed and supported above the occupant via member 422. Fasteners 440 and 454 may include such types as Velcro®, hook and loop, ties, buttons, snaps, alligator or bulldog clips and other similar types of fastening devices described herein.

Shade 430 may include a single side portion 434 or multiple side portions 434. As depicted in FIG. 12, shade 430 includes two side portions 434 divided at interface 435. Side portions 434 depend or extend from integrally or are attached to edge 462 of top portion 432. Each side portion 434 has edges 472 that extend from top portion 432 at least substantially to tire 425. Side portions 434 cover the upper portion of tire 425 when shade 430 is installed. Side portion panel(s) 434 define an opening as seen at opening 450. Opening 450 allows one to enter or leave the swing 410 and shade 430, as well as for a swing occupant to look out or be seen. Upper and lower portions of opening 450 may include fasteners 456 that enable one to increase or decrease the size of the opening 450.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A removable shade for a swing, the swing including a seat that holds an occupant and first and second members to which the seat is attached for support, the shade comprising:

a top portion;

a back portion attached to a folding edge of the top portion, the back portion providing protection to a back portion of the occupant;

a first side portion attached to a first side folding edge of the back portion, a lower part of the first side portion defining an approximately horizontal first slit extending from near a rear edge to an opposing front edge of the first side portion to fit around the first member of the swing;

a second side portion attached to a second side folding edge of the back portion, a lower part of the second side portion defining an approximately horizontal second slit extending from near a rear edge to an opposing front edge of the second side portion to fit around the second member of the swing;

a first fastener configured and arranged to connect to the first member, the first fastener connected to the top portion; and a second fastener configured and arranged to connect to the second member, the second fastener connected to the top portion.

2. The removable shade of claim 1, wherein the top portion and the back portion include indicia that mate when the shade is installed on the swing.

3. The removable shade of claim 1, wherein at least one of the top portion and side portions is made of a material selected from the group consisting of: a woven material, nylon, fabric, linen, woven linen, canvas, cotton, plastic, rubber, polymer, polyvinyl and any combination thereof.

4. The removable shade of claim 1, wherein the first and second fastener is of a type selected from the group consisting of: interference, hook and loop, tie, button, buckle, snap, alligator clip, bulldog clip and any combination thereof.

5. The removable shade of claim 1, wherein the first and second slit comprise a fastener selected from the group consisting of: interference, hook and loop, tie, button, buckle, snap, alligator clip, bulldog clip and any combination thereof.

6. The removable shade of claim 1, wherein the first side portion comprises a fastening device that closes the horizontal first slit around the second member.

7. The removable shade of claim 1, wherein the second side portion comprises a fastening device that closes the horizontal second slit around the second member.

* * * * *